US008567648B2

(12) United States Patent
Nufer et al.

(10) Patent No.: US 8,567,648 B2
(45) Date of Patent: Oct. 29, 2013

(54) SPOUT ADAPTER SYSTEM

(75) Inventors: David R. Nufer, Walled Lake, MI (US); Brent Mussatto, Commerce Township, MI (US)

(73) Assignee: Dedoes Industries, Inc., Walled Lake, MI (US)

( * ) Notice: Subject to any disclaimer, the term of this patent is extended or adjusted under 35 U.S.C. 154(b) by 163 days.

(21) Appl. No.: 13/222,038

(22) Filed: Aug. 31, 2011

(65) Prior Publication Data

US 2013/0048683 A1 Feb. 28, 2013

(51) Int. Cl.
*B65D 35/38* (2006.01)

(52) U.S. Cl.
USPC ..... 222/568; 222/511; 222/559

(58) Field of Classification Search
USPC ..... 222/568, 132, 517, 105, 511, 505, 559, 222/561
See application file for complete search history.

(56) References Cited

U.S. PATENT DOCUMENTS 4,548,344 A * 10/1985 Hestehave et al. ..... 222/464.3
4,583,668 A * 4/1986 Maynard, Jr. ..... 222/529
4,750,648 A * 6/1988 Krydiak ..... 222/484
4,793,528 A * 12/1988 Krzywdziak ..... 222/487
5,901,887 A * 5/1999 Wark ..... 222/568
2009/0302066 A1* 12/2009 Harvey ..... 222/321.1

* cited by examiner

*Primary Examiner* — Paul R Durand
*Assistant Examiner* — Donnell Long
(74) *Attorney, Agent, or Firm* — Gifford, Krass, Sprinkle, Anderson & Citkowski, P.C.

(57) ABSTRACT

A spout adapter system is provided for use with at least two different containers in which each container has a threaded fitment adapted to removably receive a threaded closure cap and in which the two different containers have different thread configurations around the dispensing opening. The system includes a first and second adapter each having two ends and a fluid passageway extending between their ends as well as a dispensing spout having a fluid passageway for dispensing fluid. The spout includes a threaded connector which threadably cooperates with a threaded connector at one end of either of the adapters so that the dispensing spout may be used with either adapter. The first adapter includes a threaded portion at its other end which is configured to cooperate with the threaded fitment of one of the containers while the other adapter has a threaded portion at its other end configured to cooperate with the threaded dispensing opening of the other container. Consequently, the different adapters enable the same spout to be utilized with different containers having different sized dispensing openings.

6 Claims, 4 Drawing Sheets

SPOUT ADAPTER SYSTEM

BACKGROUND OF THE INVENTION

I. Field of the Invention

The present invention relates generally to dispensers and, more particularly, to an adapter system which enables the same spout to be used with fluid containers having fitments of different sizes.

II. Description of Related Art

There are many different types of fluid containers that are used in manufacturing and other commercial applications. In most cases, the containers include a threaded closure opening adapted to removably receive a threaded cap. Thus, in order to dispense fluid from the container, the cap is removed by unscrewing it from the container which enables the fluid to be dispensed out through the fitment. After the desired amount of fluid is dispensed from the container, the threaded cap is oftentimes replaced on the container thus closing the fitment.

In many situations, furthermore, it would be desirable to attach a dispensing spout onto the container in order to facilitate dispensing fluid from the container. Such a spout may optionally include a valve which the user can operate in order to more carefully control the rate of dispensing from the container. Another common issue is the difficulty in pouring the fluid from the standard fitments without glugging and splashing.

Unfortunately, there currently exists no standardization for the size of the threaded fitments for containers of the type used in commercial and industrial applications. Rather, the manufacturers of such containers have merely designed the containers to suit their own particular needs or design criteria. Consequently, the threaded connections for the closure caps for these containers vary not only in diameter and pitch of the thread, but also the cross-sectional shape of the thread itself.

Due to the wide range of different thread sizes and shapes for the fitments of fluid containers, it has not previously been possible to utilize a standard spout size which is attachable to containers having different sizes or shapes of the threaded closure fitments. Since the tooling required to manufacture dispensing spouts is relatively expensive, the tooling cost to manufacture a wide variety of dispensing spouts having different thread sizes to accommodate the different thread types found on different fluid containers has proven to be prohibitive.

SUMMARY OF THE PRESENT INVENTION

The present invention provides a spout adapter system for fluid containers of the type used in commercial and industrial applications which enables a standardized spout to be readily attached to different fluid containers even though the different containers have different thread configurations around their dispensing openings, known as fitments in the industry, for receiving their respective closure caps.

In brief, the system of the present invention includes at least a first and a second adapter. Each adapter has two ends and a fluid passageway which extends between those two ends.

The system also includes a dispensing spout having a fluid passageway through which the fluid is dispensed. A threaded connector at one end of the fluid passageway on the dispensing spout threadably cooperates with a threaded connector at one end of either of the adapters. As such, the dispensing spout may be attached to either the first or second adapter by merely screwing the spout onto one end of the adapter. The dispensing spout attaches to one size can without an adapter.

The other end of the first adapter has a threaded portion which is configured to cooperate with the threaded fitment of one of the containers. Similarly, the second adapter has a threaded portion at its other end which is configured to cooperate with the threaded fitments of a different container having a different size or differently configured threaded fitment. Consequently, while different adapters are required for different containers having differently configured fitments, each adapter is able to be tlireadably attached to a standard dispensing spout which may be used with any selected adapter.

Since the tooling required to manufacture the adapters is much simpler and much less costly than the tooling required for the manufacture of the dispensing spout, the manufacture of different types of adapters for use with a standard dispensing spout becomes commercially feasible.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
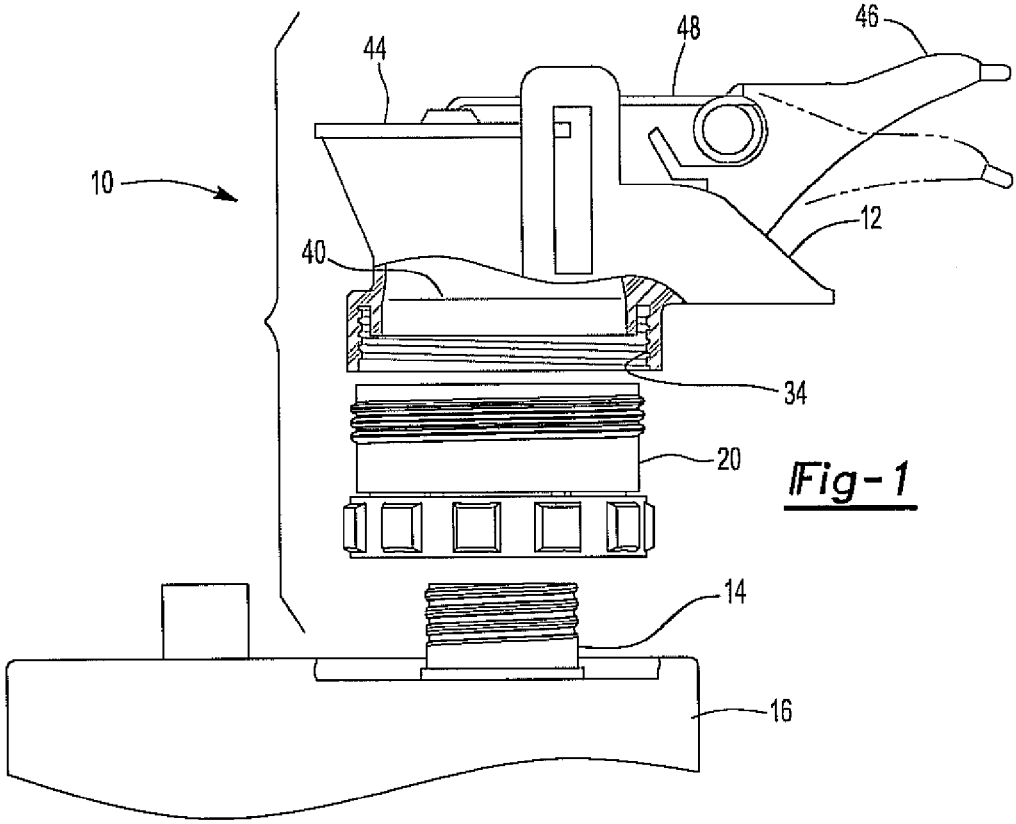
FIG. 1 is an exploded side view illustrating a preferred embodiment of the present invention.
Figure 2:
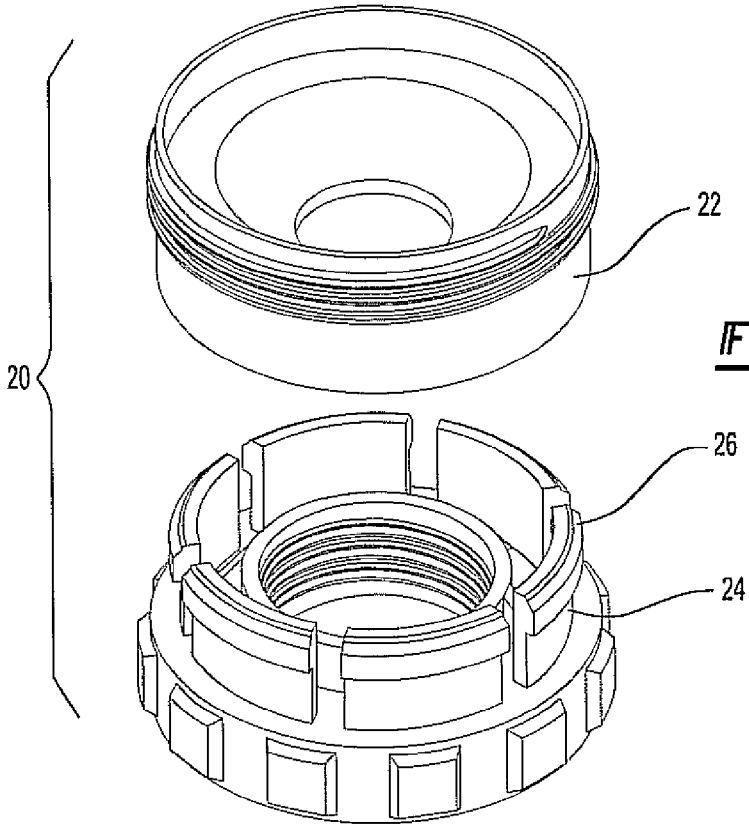
FIG. 2 is an exploded perspective view illustrating one type of adapter according to the present invention.
Figure 3:
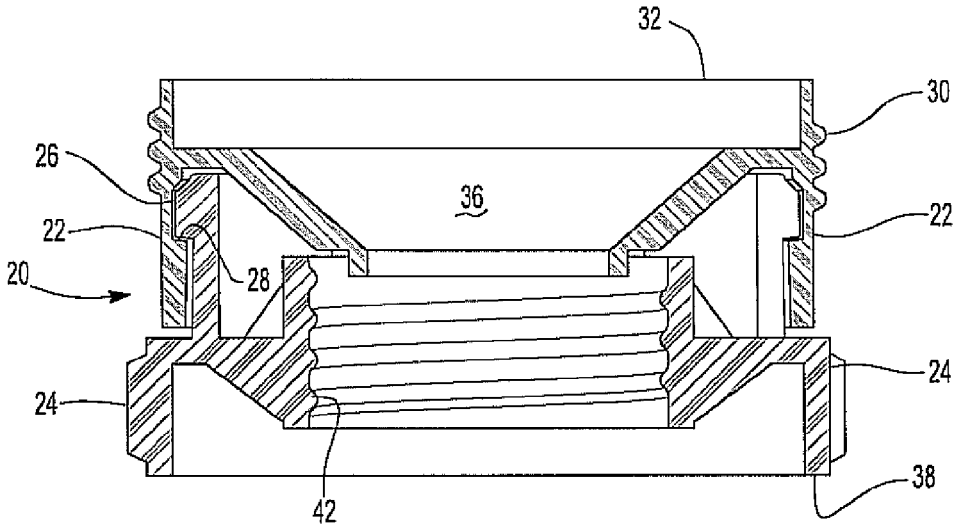
FIG. 3 is a longitudinal sectional view of the adapter illustrated in FIG. 2.

With reference first to FIGS. 1-3, a preferred embodiment of the spout adapter system 10 according to the present invention is illustrated. The system 10 includes a dispensing spout 12 which is removably secured to a threaded fitment 14 on a fluid container 16 by an adapter 20.

The adapter 20 is best shown in FIGS. 2 and 3 and includes an upper part 22 as well as a lower part 24. The lower part 24 includes a plurality of circumferentially spaced outwardly extending projections 26 which engage an annular abutment surface 28 when the upper part 22 and lower part 24 are snapped together as best shown in FIG. 3. The cooperation between the projections 26 and the annular abutment surface 28 thus allows the upper part 22 and lower part 24 of the adapter 20 to be rotated relative to each other.

A threaded connector 30 is provided around an upper end 32 of the adapter 20. The threaded connector 30 is preferably an externally threaded portion of the adapter 20 and is dimensioned to cooperate with an internally threaded connector 34 (FIG. 1) on the dispensing spout 12. Consequently, the dispensing spout 20 may be secured to the end 32 of the adapter 20 by screwing the dispensing spout connector 34 onto the adapter threaded connector 30 which simultaneously fluidly connects a fluid passageway 36 formed between the upper end 32 and a lower end 38 of the adapter 20 and a fluid dispensing passageway 40 (FIG. 1) in the dispensing spout 12.

The adapter 20 also includes a threaded portion 42 which is dimensioned to threadably engage the threaded fitment 14 of the container 16. It will be understood, of course, that the diameter, pitch, and cross-sectional shape of the threaded portion 42 will vary depending upon the configuration of the threaded dispensing opening on the particular container 16. However, even though the threaded portion 42 may vary from one container to the next, the threaded connector 30 at the upper end 32 of the adapter 20 remains constant regardless of the fluid container 16.

In use, the second part 24 of the adapter 20 is first connected to the container 16 by screwing the threaded portion 42 of the adapter 20 onto the threaded fitment 14 of the container 16. The dispensing spout 12 is similarly threadably mounted to the threaded connector 30 and rotationally positioned as desired relative to the container 16. Upon tightening of the lower part 24 of the adapter 20, the projections 26 compress against the abutment surface 28 which not only seals the adapter parts 22 and 24 together, but also locks the dispensing spout 12 at the desired rotational position relative to the container 16.

With reference particularly to FIG. 1, the dispensing spout 12 includes a slide closure 44 which is movable between a closed position, illustrated in solid line, and an open position, illustrated in phantom line, by pivoting an actuator 46 between its closed position (solid line) and its open position (phantom line). In its closed position, the slide closure 44 covers the dispensing opening of the spout 12 and prevents the dispensing of fluid from the container 16. Conversely, in its open position, the slide closure 44 opens the dispensing opening in the spout 12 so that fluid may be dispensed from the container 16. Additionally, by variably opening the slide closure 44, the rate of dispensing from the container 16 may be closely controlled by the operator. Additionally, a spring 48 urges the slide closure 44 towards its closed position.

Figure 4:
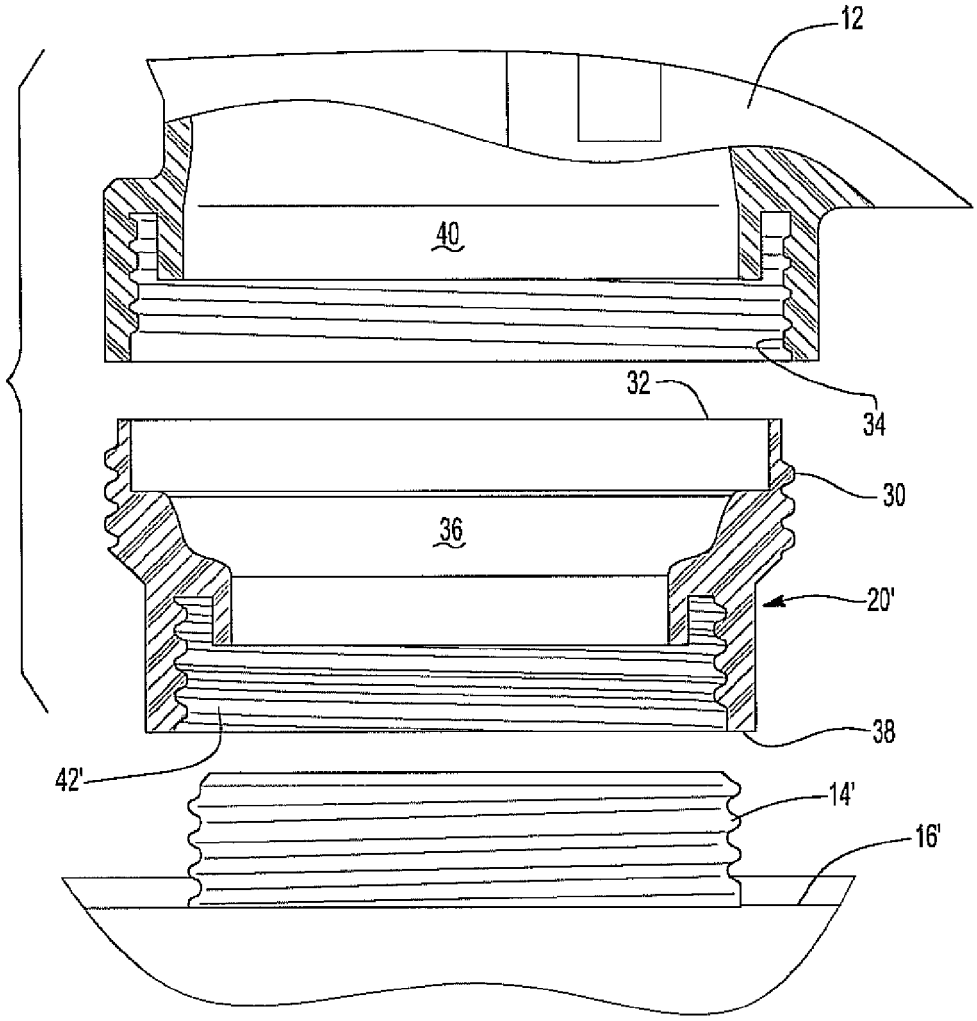
FIG. 4 is a fragmentary longitudinal sectional view illustrating the system of the present invention with a different adapter.
Figure 5:
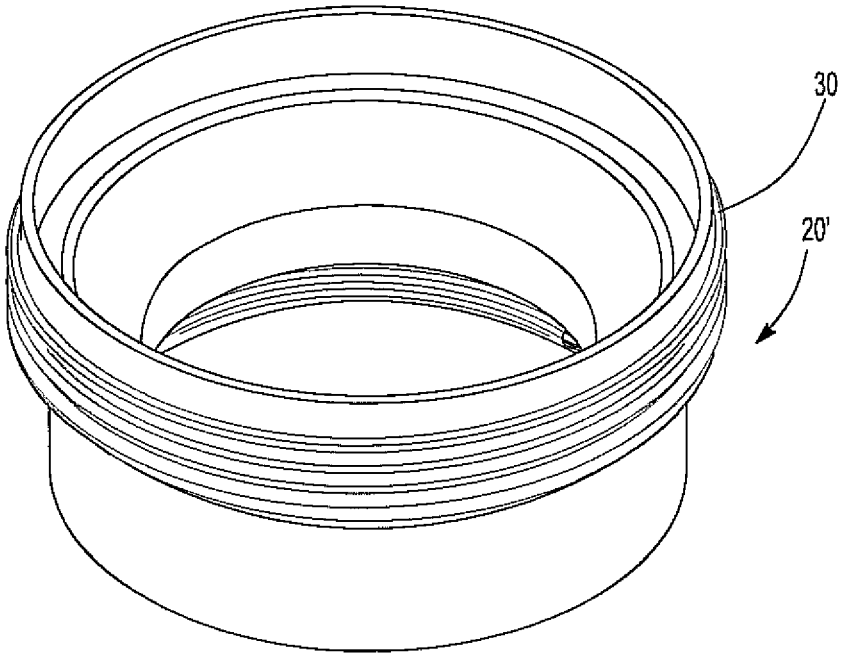
FIG. 5 is an elevational view of the adapter illustrated in FIG. 4.

With reference now to FIGS. 4 and 5, a different adapter 20' is illustrated which, unlike the first adapter 20 (FIGS. 1-3), is of a one piece construction. As before, however, the adapter 20' includes an upper end 32 with a threaded connector 30 dimensioned to threadably engage the threaded connector 34 on the spout 12 thus allowing the spout 12 to be used with either the adapter 20 (FIGS. 1-3) or the adapter 20'.

The adapter 20' also includes a threaded portion 42' adjacent its other end 38. The threaded portion 42' differs, however, from the threaded portion 42 of the first adapter 20 since the threaded portion 42' is designed both in size, pitch, and thread cross-sectional shape to threadably cooperate with the threaded fitment 14' of a different container 16'.

Figure 6:
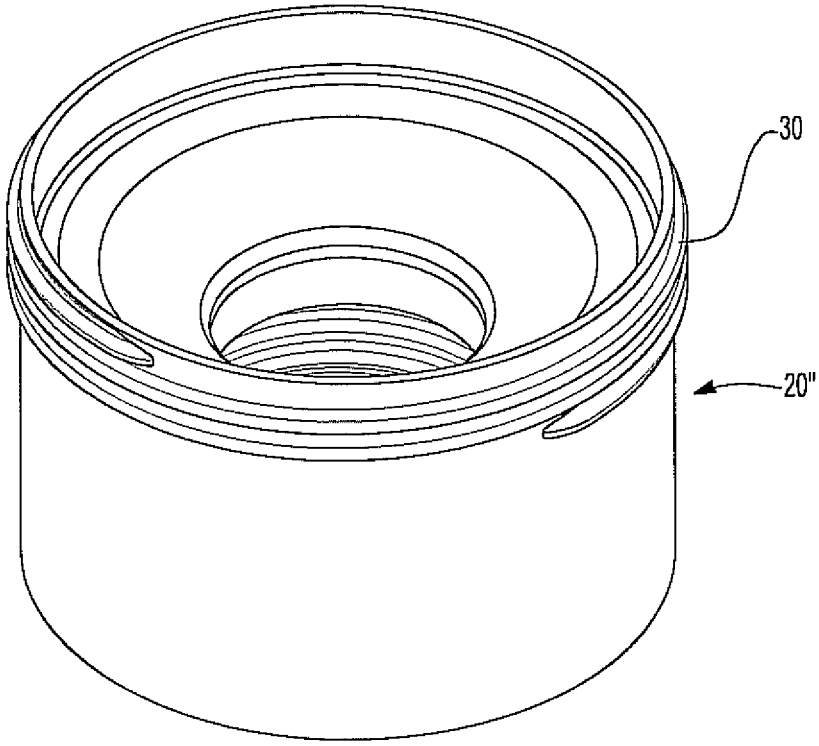
FIG. 6 is an elevational view illustrating a still further type of adapter.
Figure 7:
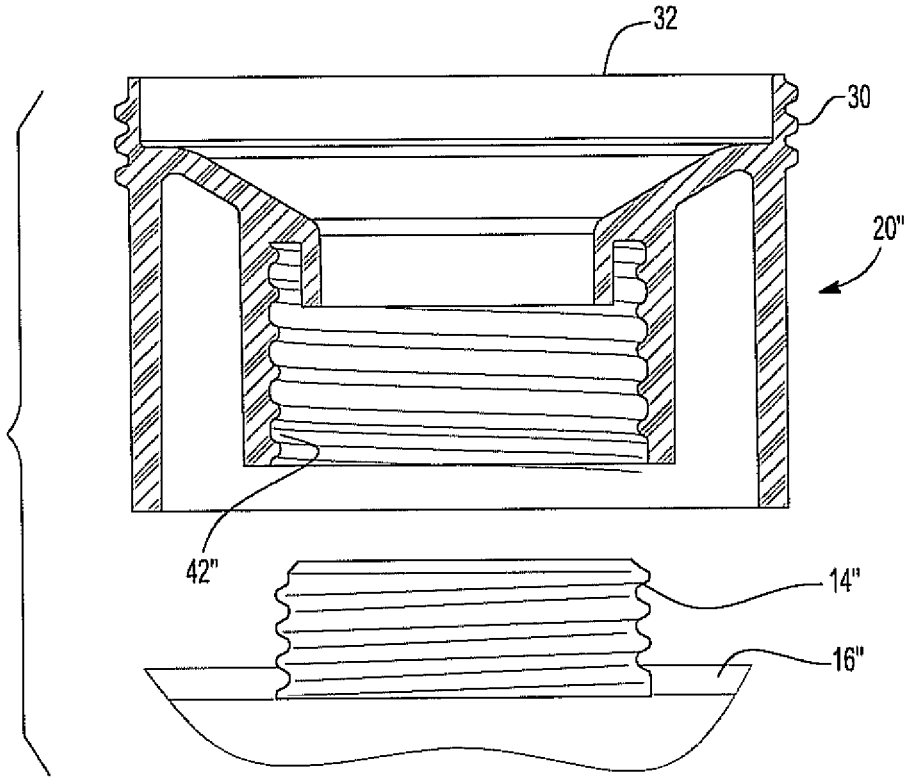
FIG. 7 is a sectional view of the adapter illustrated in FIG. 6.

With reference now to FIGS. 6 and 7, a still further adapter 20" is illustrated for use with a still different container 16" having a threaded closure fitment 14" with threads of a configuration different from the other two containers 16 and 16'.

The adapter 20", like the other adapters 20 and 20', includes a threaded connector 30 adjacent its upper end 32 dimensioned to threadably engage the threaded connector 34 (FIG. 4) on the dispensing spout 12. However, the adapter 20" also includes a threaded portion 42" which is different in configuration than the other adapters 20 and 20' and configured to threadably cooperate with the threaded closure fitment 14" of the container 16". As before, in use the adapter 20" is threadably mounted to the container fitment 14" while the dispensing spout 12 is threadably mounted to the upper end 32 of the adapter 20".

From the foregoing it can be seen that the present invention provides a spout adapter system which enables the same spout to be used with fluid containers having different dispensing outlets with different thread configurations by simply using different types of adapters. However, since the same dispensing spout 12 may be used regardless of the type of adapter, the overall tooling cost for the system remains commercially feasible. This is particularly true since the tooling cost for the adapters is relatively small. Furthermore, fluid dispensing may be more accurately and easily metered without glugging and splashing.

Having described my invention, however, many modifications thereto will become apparent to those skilled in the art to which it pertains without deviation from the spirit of the invention as defined by the scope of the appended claims.

I claim:

1. A spout adapter system for use with at least two different containers having different threaded dispensing fitments which differ from each other in diameter, pitch, and/or cross-sectional shape, said system comprising:

at least a first and a second adapter, each adapter having two ends and a fluid passage extending between said ends, a dispensing spout having a fluid passageway and a threaded connector which threadably cooperates with a threaded connector at one end of either of said adapters to fluidly connect said dispensing spout passageway with said fluid passage in either of said adapters, said first adapter having a coupler at its other end dimensioned to threadably engage the dispensing fitment of one of the different containers and said second adapter having a second coupler at its other end dimensioned to threadably engage the dispensing fitment of the other of the different containers.

2. The spout adapter system as defined in claim 1 wherein each said adapter comprises a plastic construction.

3. The spout adapter system as defined in claim 1 wherein said spout comprises a plastic construction.

4. The spout adapter system as defined in claim 1 wherein at least one of said adapters comprises a one piece plastic construction.

5. The spout adapter system as defined in claim 1 wherein said spout comprises a sliding closure movable between a closed position in which said sliding closure closes said dispensing spout fluid passageway and an open position in which said sliding closure opens said dispensing spout fluid passageway to enable fluid to be dispensed from an attached container.

6. The spout adapter system as defined in claim 5 and comprising an actuator pivotally attached to said dispensing spout and said sliding closure and movable between a first and second position to respectively move said sliding closure between said closed position and said open position, and a spring which urges said actuator towards said closed position.

* * * * *